US009826847B2

(12) United States Patent
Caruso

(10) Patent No.: US 9,826,847 B2
(45) Date of Patent: Nov. 28, 2017

(54) MULTI-PIECE BED SKIRT

(71) Applicant: Target Brands, Inc., Minneapolis, MN (US)

(72) Inventor: Angela N. Caruso, Eagan, MN (US)

(73) Assignee: Target Brands, Inc., Minneapolis, MN (US)

( * ) Notice: Subject to any disclaimer, the term of this patent is extended or adjusted under 35 U.S.C. 154(b) by 231 days.

(21) Appl. No.: 14/755,117

(22) Filed: Jun. 30, 2015

(65) Prior Publication Data

US 2017/0000272 A1 Jan. 5, 2017

(51) Int. Cl.
*A47G 9/02* (2006.01)

(52) U.S. Cl.
CPC ..... *A47G 9/0292* (2013.01)

(58) Field of Classification Search
CPC ..... A47G 9/0292; A47G 9/0284; A47G 9/02
See application file for complete search history.

(56) References Cited

U.S. PATENT DOCUMENTS 4,141,097 A 2/1979 Levinsohn et al.
4,386,439 A * 6/1983 Roccograndi ..... A47G 9/0284 5/493
5,353,456 A 10/1994 Evans
6,035,469 A 3/2000 Schrougham
6,151,731 A 11/2000 Saparow
6,971,129 B2 12/2005 Wootten, Jr. et al.
D630,878 S 1/2011 Kennett
D634,146 S 3/2011 Kennett
8,214,948 B2 7/2012 Gatzke et al.
8,393,024 B2 3/2013 Mitchell
8,650,681 B2 2/2014 Masoncup
8,997,280 B1 * 4/2015 Hannula ..... A47G 9/0246 5/497
2011/0308013 A1 12/2011 Kennett
2012/0233775 A1 9/2012 Flinn
2014/0298585 A1 * 10/2014 Grama ..... A47G 9/0292 5/493
2014/0338128 A1 11/2014 Robson
2015/0013067 A1 1/2015 Coughlin

OTHER PUBLICATIONS

Image of Restoration Hardware bed skirt, publicly available at least as early as Oct. 2014, 1 page.

* cited by examiner

*Primary Examiner* — Eric J Kurilla
(74) *Attorney, Agent, or Firm* — Leanne Taveggia Farrell; Westman, Champlin & Koehler, P.A.

(57) ABSTRACT

A bed skirt includes a single panel having four sides and made of a coarse woven or non-woven fabric and six panels made of a fine woven fabric. The six panels includes three border panels and three skirt panels. Each border panel is stitched to a respective side of the single panel along border seams. Each skirt panel is stitched to at least one of the three border panels along skirt seams. The skirt seams are configured to align with top edges of a bed base.

18 Claims, 6 Drawing Sheets

MULTI-PIECE BED SKIRT

BACKGROUND

A bed skirt is made at least partially of decorative fabric, is placed between the mattress and the bed base, such as a box-spring, and hangs from the top of the bed base to the floor. Today, bed skirts are used to give a stylish appearance to the bed and cover the bed base as well as any space underneath the bed base that may be used for storage. Historically, bed skirts were used to block drafts, which could chill the undersides of the bed.

The discussion above is merely provided for general background information and is not intended to be used as an aid in determining the scope of the claimed subject matter.

SUMMARY

A bed skirt includes a single panel having four sides and made of coarse utility woven or non-woven fabric and six panels made of finely woven. The six panels includes three border panels and three skirt panels. Each border panel is stitched to a respective side of the single panel along border seams. Each skirt panel is stitched to at least one of the three border panels along skirt seams. The skirt seams are configured to align with top edges of a bed base.

A bed skirt includes a platform section sized to correspond with a top surface of a bed base. The platform section including a main panel, a first longitudinal panel, a second longitudinal panel and a lateral panel. The first longitudinal panel is stitched to a first longitudinal edge of the main panel along a first longitudinal panel seam. The second longitudinal panel is stitched to a second longitudinal edge of the main panel along a second longitudinal panel seam. The lateral panel is stitched to a first lateral edge of the main panel along a lateral panel seam. The first longitudinal panel, the lateral panel and the second longitudinal panel form a border around a portion of the main panel. The bed skirt also includes three skirts. A first skirt section is stitched to the first longitudinal panel along a first longitudinal skirt seam that aligns with a first longitudinal top edge of the bed base and drops from the first longitudinal skirt seam to a floor. A second skirt section is stitched to the second longitudinal panel along a second longitudinal skirt seam that aligns with a second longitudinal top edge of the bed base and drops from the second longitudinal skirt seam to the floor. A third skirt section is stitched to the lateral longitudinal panel along a lateral skirt seam that aligns with a lateral top edge of a foot of the bed base and drops from the lateral skirt seam to the floor. The first skirt section, the first longitudinal panel, the second skirt section, the second longitudinal panel, the lateral skirt section and the lateral panel are made from the same fabric.

A method of assembling a bed includes placing a bed skirt on a bed base. The bed skirt includes a single panel of inexpensive utility fabric having four sides and six panels of more expensive fabric than the utility fabric of the single panel. The six panels include three border panels each stitched to a respective side of the single panel along border seams and three skirt panels each stitched to at least one of the three border panels along skirt seams. The bed skirt is arranged on the bed base by aligning the skirt seams with top edges of the bed base so that each skirt panel drops from each skirt seam to a floor supporting the bed base.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Bed skirts are placed on a bed base, such as a box-spring, to cover the bed base and any space between the bed base and the floor. A bed skirt has a platform section and at least three drop skirts. The platform section is sized to correspond with a top surface of the bed base and traditionally is entirely made with a utility material, usually undyed and of a coarsely woven or non-woven fabric. The three drop skirts are stitched to a pair of longitudinal sides of the platform section and to a lateral side (or foot) of the platform section and are made with a finer material, usually dyed and of a higher thread count then the platform material in the case of the platform material being made of a woven material. Because the utility material of the platform section ends and the skirts begin at the longitudinal sides and lateral foot of the bed base, the undyed utility material of past bed skirts is exposed even with a mattress laid on top of the platform section of the bed skirt because unlike the bed base, a mattress has rounded sides and edges rather than square sides and edges and because the mattress fill may have irregular sizes.

The embodiments described herein add the finer drop skirt fabric of the three drop skirts up onto the edges of the platform section of the bed skirt so that none of the undyed, utility fabric is visible. However, embodiments do not just extend the finer material of the three drop skirt pieces up onto the platform, which would fail to provide the crisp edges provided by the seams being placed at the top edges of the bed base. Instead, three additional pieces of skirt material act like borders and are used so that a total of six pieces of the same skirt material and one piece of platform material comprise the bed skirt.

Figure 1:
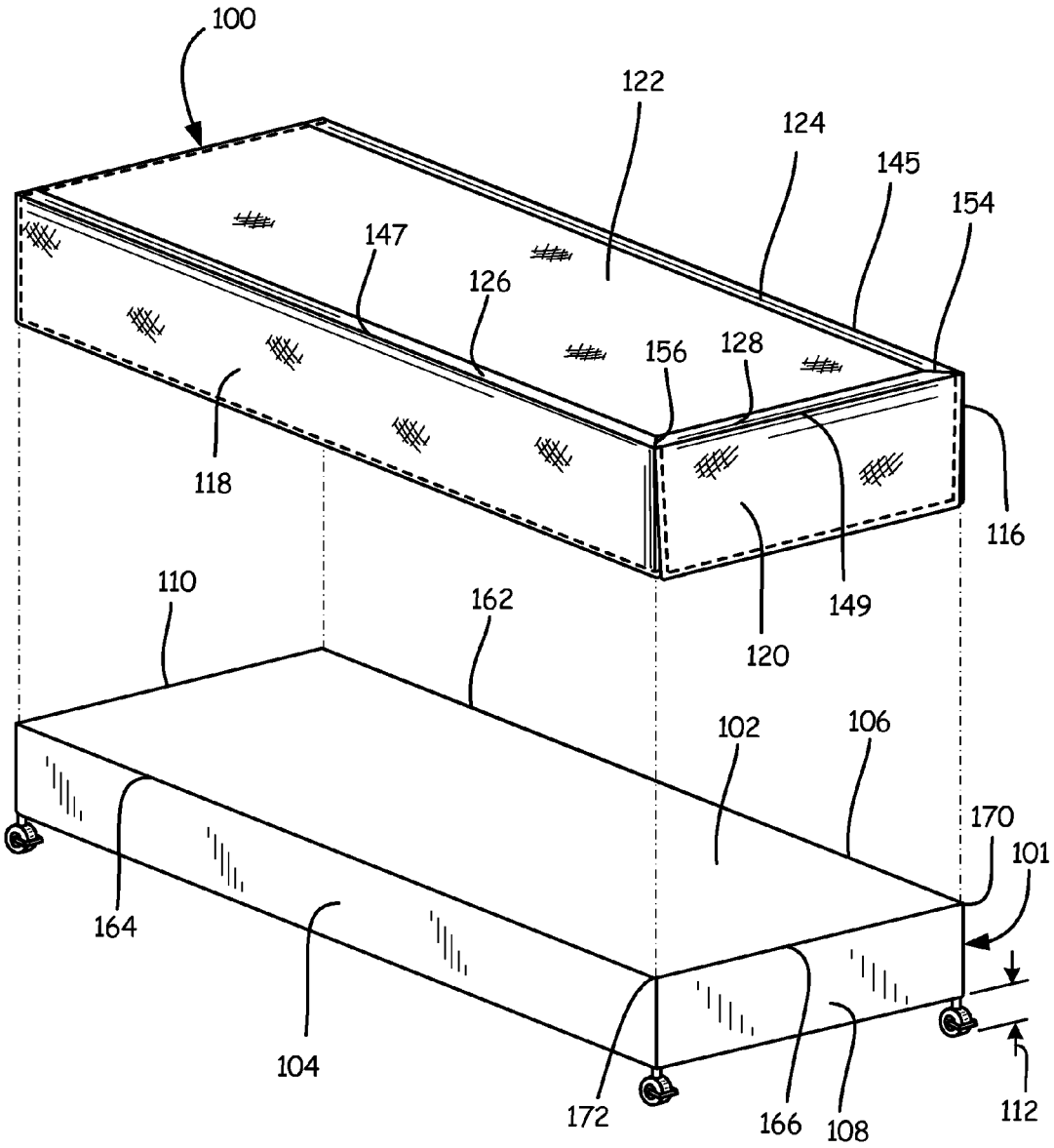
FIG. 1 is a perspective view of a bed skirt exploded from a bed base according to one embodiment.
Figure 2:
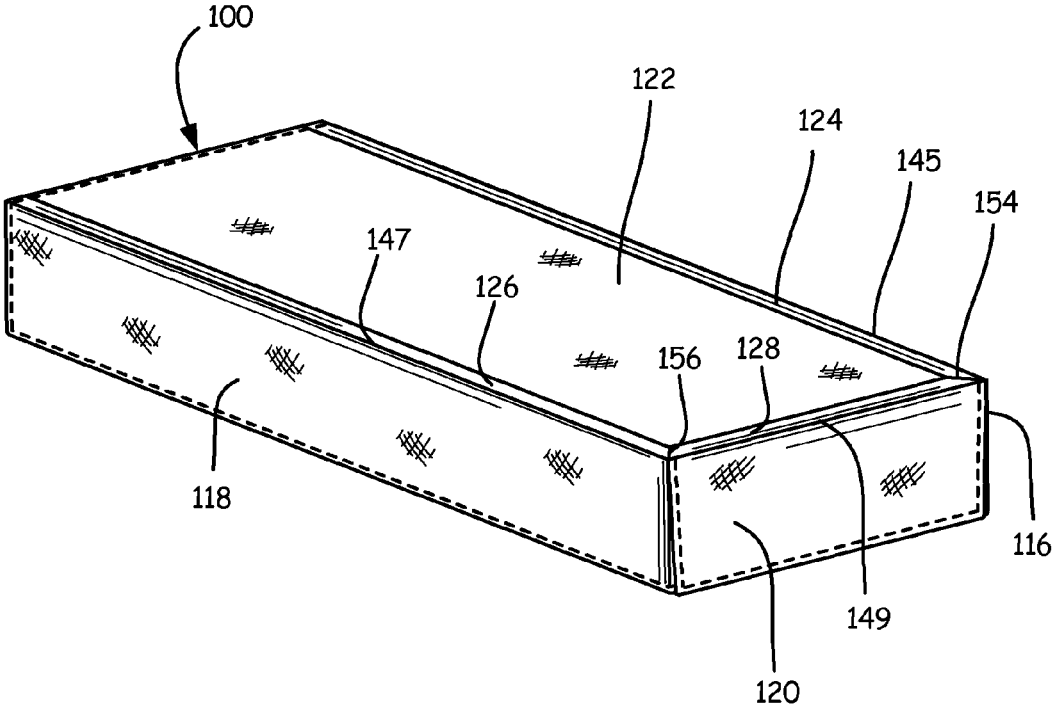
FIG. 2 is a perspective view of the bed skirt of FIG. 1 covering the bed base of FIG. 1.
Figure 3:
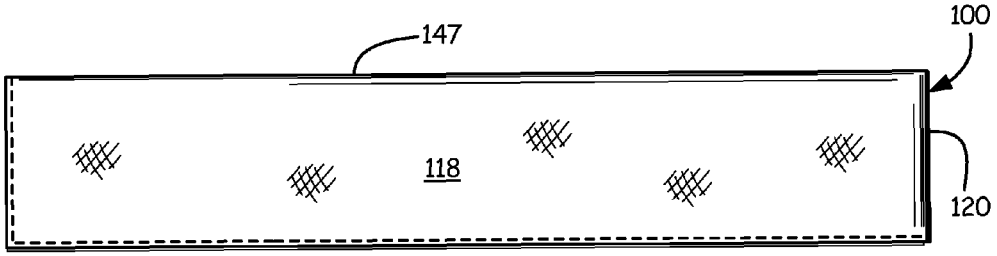
FIG. 3 is a side view of FIG. 2.
Figure 4:
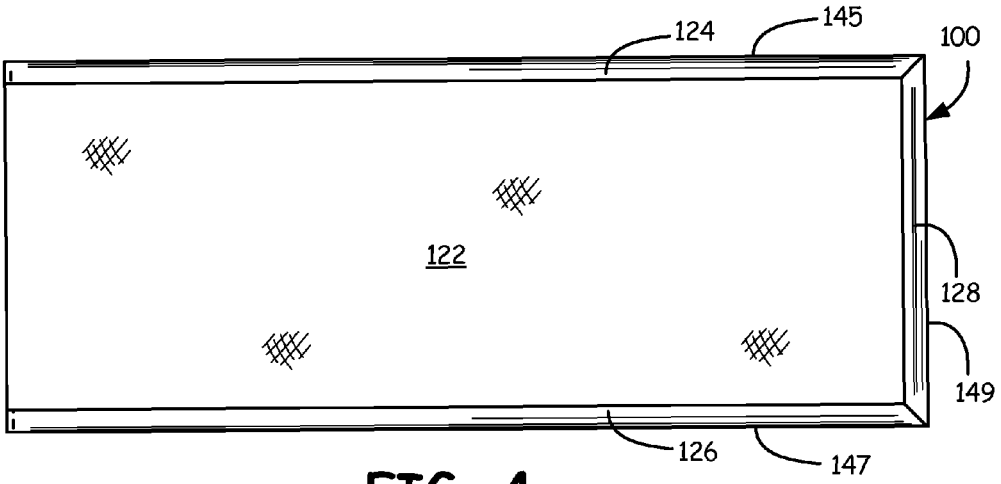
FIG. 4 is a top view of FIG. 2.
Figure 5:
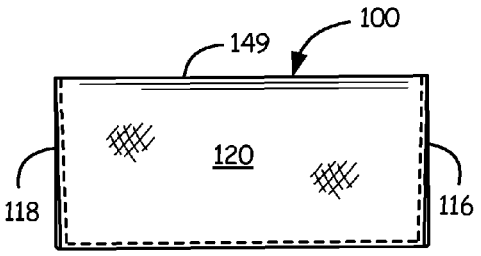
FIG. 5 is an end view of FIG. 2 showing a foot.
Figure 6:
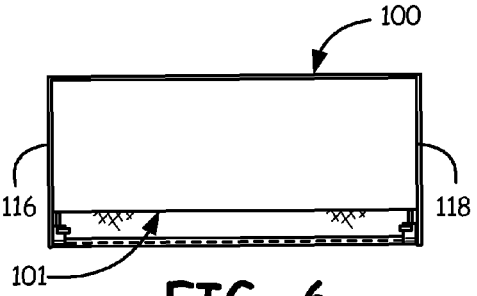
FIG. 6 is an end view of FIG. 2 showing a head.
Figure 7:
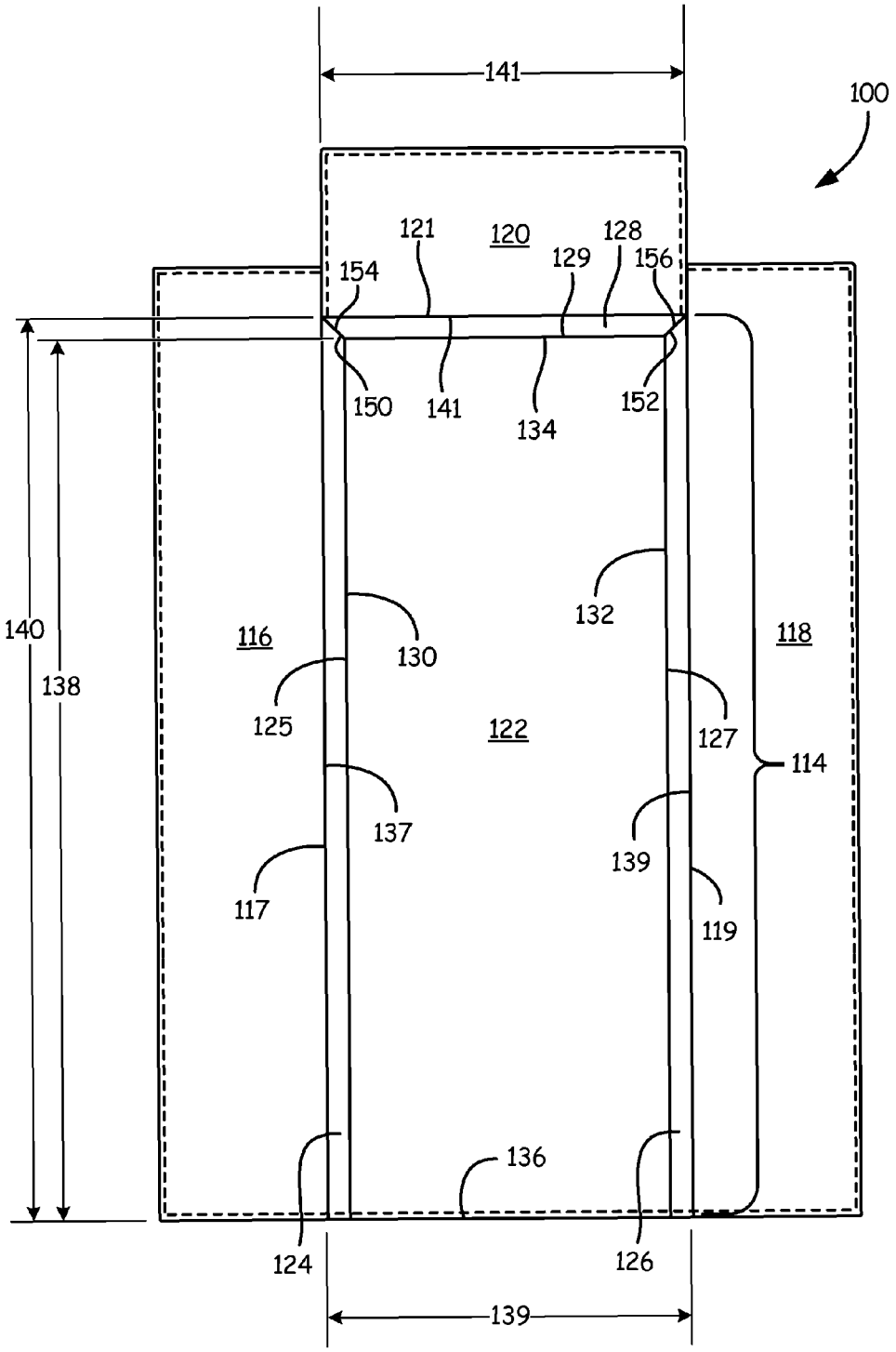
FIG. 7 is a top plan view of the bed skirt of FIGS. 1 and 2 not covering the bed base.

FIG. 1 illustrates a perspective view of a bed skirt 100 exploded from a bed base 101 according to one embodiment. FIG. 2 is a perspective view of bed skirt 100 covering bed base 101. In FIG. 1, bed base 101 is raised off the floor with a set of legs by a space 112 and includes a top surface 102, a first longitudinal side 104, a second longitudinal side 106, a first lateral side or foot 108 and a second lateral side or head 110. Bed skirt 100 covers top surface 102, first longitudinal side 104, second longitudinal side 106, first lateral side 108 and space 112. FIGS. 3-6 are elevation views of FIG. 2 including a first side view in FIG. 3 (the opposing side view is a minor image), a top view in FIG. 4, an end view showing a foot in FIG. 5 and an opposing end view showing a head in FIG. 6. FIG. 7 is a top plan view of a top side of bed skirt 100 when the bed skirt is not covering a bed base and FIG. 8 is a bottom plan view of a bottom side of bed skirt 100 when the bed skirt is not covering a bed base.

Figure 8:
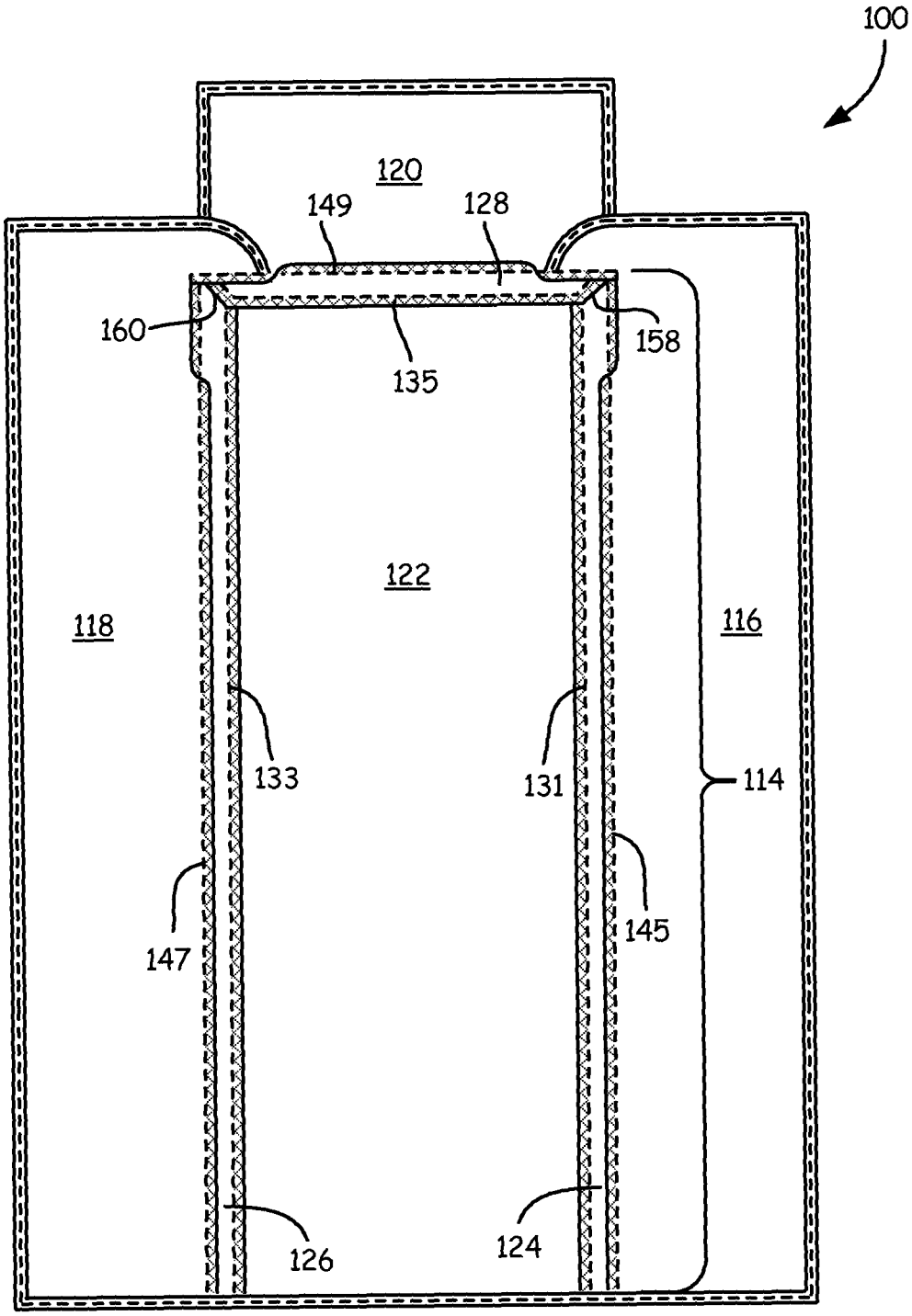
FIG. 8 is a bottom plan view of the bed skirt of FIGS. 1 and 2 not covering the bed base.

As best illustrated in FIGS. 7 and 8 and in one embodiment, bed skirt 100 includes a platform section 114 and three skirt sections 116, 118 and 120. Platform section 114 is sized to correspond with a size of top surface 102 of bed base 101 and includes four panels of material including a main panel 122, a first longitudinal panel 124, a second longitudinal panel 126 and a lateral panel 128. As best illustrated in FIGS. 7 and 8 and in alternative nomenclature, bed skirt 100 includes a single panel 122 and six additional panels including three skirt panels 116, 118 and 120 and three border panels 124, 126 and 128. Single panel 122 and the three border panels 124, 126 and 128 when stitched together are sized to correspond with top surface 102 of bed base 101.

Main panel or single panel 122 is made of an inexpensive, undyed coarsely woven or non-woven utility fabric and has a first longitudinal edge 130, an opposing second longitudinal edge 132, a first lateral edge 134 and an opposing second lateral edge 136. Main panel or single panel 122 includes a length 138 that is smaller than a length 140 of platform section 114 and a width 139 that is smaller than a width 141 of platform section 114. The purpose of platform section 114 is to support the three skirt sections or skirt panels 116, 118 and 120 so that they fall from the top perimeter edges of a bed base to a floor. The three skirt sections or skirt panels 116, 118 and 120 and the three border panels or first longitudinal panel 124, second longitudinal 126 and lateral panel 128 are all made of the same more expensive, dyed finely woven fabric, which has a higher thread count than the utility fabric of the main panel or single panel 122 when the utility fabric is made of a woven fabric.

First longitudinal panel or first border panel 124 has an inside edge 125 that is stitched to first longitudinal edge 130 of main panel or single panel 122 along a first longitudinal panel seam or border seam 131. As illustrated in FIG. 8, first longitudinal panel seam or border seam 131 includes a seam allowance that has been surged to prevent fraying. Second longitudinal panel or second border panel 126 has an inside edge 127 that is stitched to second longitudinal edge 132 of main panel or single panel 122 along a second longitudinal panel seam or border seam 133. As illustrated in FIG. 8, second longitudinal panel seam or border seam 133 includes a seam allowance that has been surged to prevent fraying. Lateral panel or third border panel 128 has an inside edge 129 that is stitched to lateral edge 134 of main panel or single panel 122 along a lateral panel seam or border seam 135. As illustrated in FIG. 8, lateral panel seam or border seam 135 includes a seam allowance that has been surged to prevent fraying. Together, first longitudinal or border panel 124, second longitudinal or border panel 126 and lateral or border panel 128 form a border around a portion or three sides of main panel or single panel 122. In other words, each border panel 124, 126 and 128 is stitched to a respective side of main panel or single panel 122 along border seams 131, 133 and 135.

First skirt section or skirt panel 116 has an inside edge 117 that is stitched to an outside edge 137 of first longitudinal or border panel 124 along a first longitudinal skirt seam or skirt seam 145. As illustrated in FIG. 8, first longitudinal skirt seam 145 includes a seam allowance that has been surged to prevent fraying. Second skirt section or skirt panel 118 has an inside edge 119 that is stitched to an outside edge 139 of second longitudinal or border panel 126 along a second longitudinal skirt seam or skirt seam 147. As illustrated in FIG. 8, second longitudinal skirt seam 147 includes a seam allowance that has been surged to prevent fraying. Lateral skirt section or skirt panel 120 has an inside edge 121 that is stitched to an outside edge 141 of lateral or border panel 128 along a lateral skirt seam or skirt seam 149. As illustrated in FIG. 8, lateral skirt seam 149 includes a seam allowance that has been surged to prevent fraying. In other words, each skirt panel 116, 118 and 120 is stitched to a respective one of the three border panels 124, 126 and 128 along skirt seams 145, 147 and 149.

Still further, first longitudinal panel or first border panel 124 includes a first end 150, second longitudinal panel or second border panel 126 includes a first end 152 and lateral panel or third border panel 128 includes a first end 154 and a second end 156. First end 150 of first border panel 124, first end 152 of second border panel 126 and first end 154 and second end 156 of third border panel 128 are mitered or cut at an angle. The mitered first end 150 of first border panel 124 is joined with mitered first end 154 of third border panel 128 by stitching along a first corner seam 158 and the mitered first end 152 of second border panel 126 is joined with mitered second end 156 of third border panel 128 by stitching along a second corner seam 160.

As illustrated in FIG. 8, a portion of the hems of skirt panels 116 and 118 include curved ends that are stitched to portions of skirt panel 120. These additional seams provide "pockets" proximal to mitered corner seams 158 and 160 for additional positioning of bed skirt 100 on bed base 101.

With reference back to FIGS. 1 and 2, skirt seams or first longitudinal skirt seam 145, second longitudinal skirt seam 147 and lateral skirt seam 149 are aligned with respective top edges or first longitudinal edge 162, second longitudinal top edge 164 and lateral top edge 166 of bed base 101 when bed skirt 100 covers bed base 101. More specifically and as illustrated in FIG. 2, skirt panels 116, 118 and 120 drop from skirt seams or first longitudinal skirt seam 145, second longitudinal skirt seam 147 and lateral skirt seam 149 to a floor to which bed base 101 is being supported. The combination of skirt seams 145, 147 and 149 in addition to corner seams 158 and 160 provide bed skirt 100 with repeatable alignment with top edges or first longitudinal top edge 162, second longitudinal top edge 164 and lateral top edge 166 of bed base 101.

Figure 9:
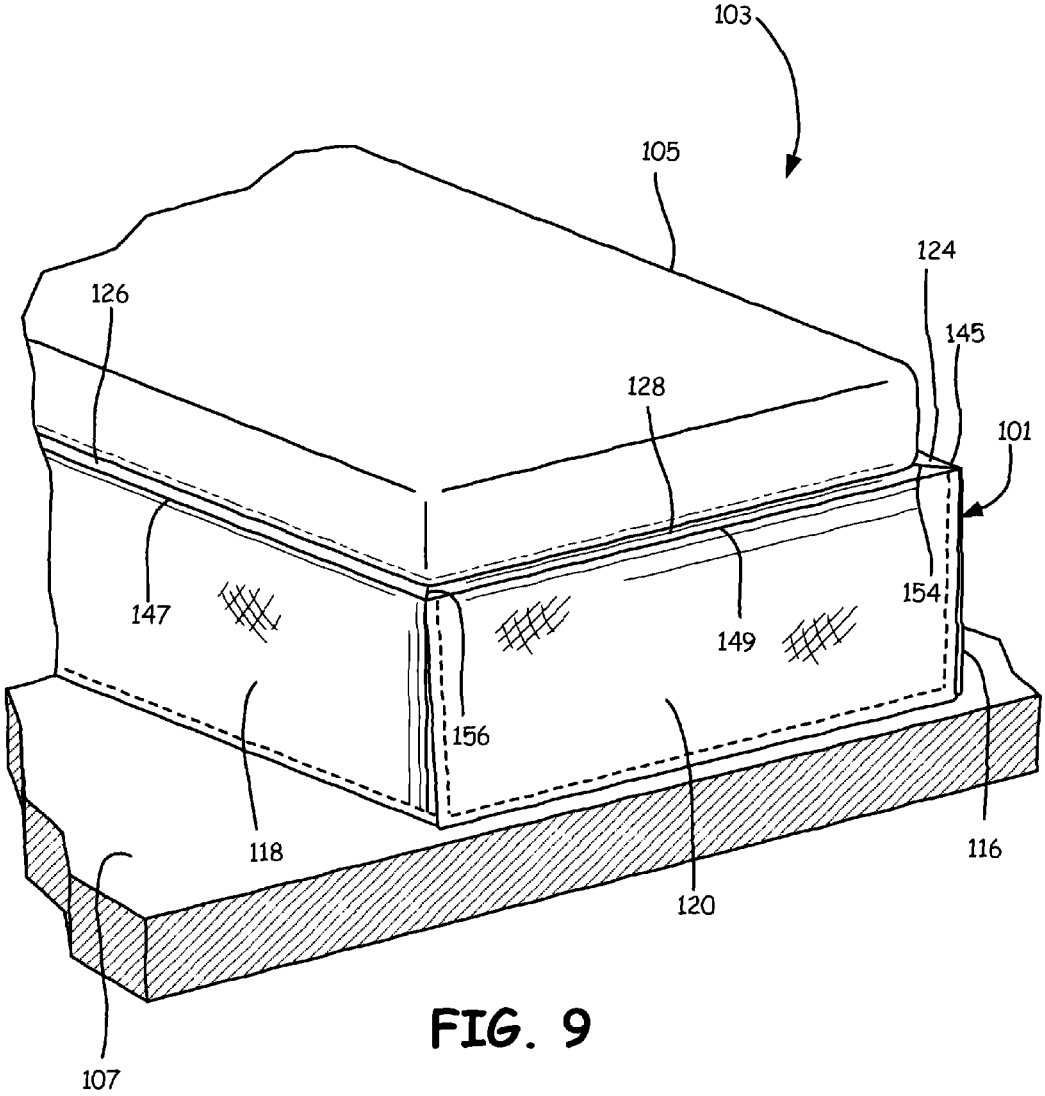
FIG. 9 is a perspective view of a portion of a bed including the bed skirt illustrated in FIGS. 1-8 according to one embodiment.

FIG. 9 is a perspective view of a portion of a bed 103 including bed skirt 100 supported by a floor 107 according to one embodiment. In FIG. 9, bed skirt 100 is placed on bed base 101 (FIG. 1) and arranged so that skirt seams 145, 147 and 149 are aligned with respective top edges 162, 164 and 166 (FIG. 1) of bed base 101 so that each skirt panel 116, 118 and 120 drops from each skirt seam to floor 107, which supports bed base 101 and therefore bed 103. As previously described, skirt seams 145, 147 and 149 provide bed skirt 100 with permanent and repeatable alignment with top edges 162, 164 and 166 because these edges will never disappear like an ironed edge would upon washing bed skirt 100.

When placing bed skirt 100 on bed base 101, the bottom side of bed skirt 100 (illustrated in plan view in FIG. 8) is oriented face down relative to top surface 102 of bed base 101. The top side of bed skirt 100 (illustrated in plan view in FIG. 7) is oriented face up relative to top surface 102 of bed base 101. As illustrated in FIG. 7, the bottom side includes surged seam allowances for border seams 131, 133 and 135 and skirt seams 145, 147 and 149 and are therefore hidden from view. When arranging bed skirt 100 on bed base 101, not only are skirt seams 145, 147 and 149 aligned with top edges 162, 164 and 166 of bed base 101, but the mitered corners and corner seams 158 and 160 are also aligned with the corresponding top corners 170 and 172 (FIG. 1) of base bed 101. In particular, first mitered end 150 of border panel 124 and first mitered end 154 of border panel 128, which are stitched together along corner seam 158, are aligned with top corner 170 of bed base 101. In addition, first mitered end 152 of border panel 126 and second mitered end 156 of border panel 128, which are stitched together along corner seam 160, are aligned with top corner 172 of bed base 101.

Further, a mattress 105 is then placed on top of bed skirt 100, which is already arranged on bed base 101. As illustrated in FIG. 9, mattress 105 entirely blocks single panel or main panel 122 from view. In this way, the finer, dyed fabric of skirt panels 116, 118 and 120 is moved up onto the edges of the platform section of bed skirt 100 as border panels 124, 126 and 128 so that none of the undyed, utility fabric is visible. As previously discussed, border panels 124, 126 and 128 do not just extend the finer, dyed fabric up onto the platform. Instead, skirt seams 145, 147 and 149 provide the crisp edges for aligning bed skirt 100 with top edges 162, 164 and 166 of bed base 101.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A bed skirt configured to cover a four-sided bed base and configured to be located under a mattress, the bed skirt comprising:

a single panel having four sides including a first longitudinal edge, an opposing second longitudinal edge, a first lateral edge and a second opposing lateral edge and made of a first fabric, wherein the single panel is configured to cover a surface area of a top surface of the bed base that is less than a total surface area of the top surface of the bed base; and six panels made of a second fabric that is different from the first fabric, wherein the six panels comprise:

a first border panel having inside and opposing outside edges where the inside edge of the first border panel is stitched to the first longitudinal edge of the single panel along a first border seam;

a second border panel having inside and opposing outside edges where the inside edge of the second border panel is stitched to a second longitudinal edge of the single panel along a second border seam;

a third border panel having inside and opposing outside edges where the inside edge of the third border panel is stitched to the first lateral edge of the single panel along a third border seam; and a first skirt panel stitched to the outside edge of the first border panel along a first skirt seam;

a second skirt panel stitched to the outside edge of the second border panel along a second skirt seam;

a third skirt panel stitched to the outside edge of the third border panel along a third skirt seam;

wherein the first, second and third skirt seams provide permanent folds to the bed skirt and are configured to align with top edges of the bed base where the top surface of the bed base intersects with three of the four sides of the bed base so that the first, second and third skirt panels cover three of the four sides of the bed base.

2. The bed skirt of claim 1, wherein the single panel and the first, second and third border panels when stitched together are configured to be sized to correspond with the top surface of the bed base.

3. The bed skirt of claim 1, wherein the first, the second and third skirt panels are configured to drop from the respective first, second and third skirt seams in a direction of a floor on which the bed base is supported.

4. The bed skirt of claim 1, wherein the single panel of the first fabric is entirely blocked from view when the mattress is configured to be centered on top of the bed base.

5. The bed skirt of claim 1, wherein a first end of the first border panel joins a first end of the second border panel and a first end of the third border panel joins a second end of the second border panel at mitered corners, the mitered corners being stitched together.

6. The bed skirt of claim 1, further comprising a top side and a bottom side, wherein the bottom side includes surged seam allowances for the first, second and third border seams and the first, second and third skirt seams.

7. A bed skirt configured to cover a four sided bed base and configured to be located under a mattress, the bed skirt comprising:

a platform section configured to be sized to correspond with a top surface of the bed base, the platform section comprising:

a main panel that is configured to cover a surface area on the top surface of the bed base that is less than a total surface area of the top surface of the bed base and includes a first longitudinal edge, an opposing second longitudinal edge, a first lateral edge and a second opposing lateral edge, wherein the first longitudinal edge of the main panel is positioned inwardly from a first longitudinal side of the bed base, the second longitudinal edge of the main panel is positioned inwardly from a second longitudinal side of the bed base, the first lateral edge of the main panel is positioned inwardly from a first lateral side of the bed base and the second lateral edge of the main panel is configured to align with a second lateral side of the bed base;

a first longitudinal panel having an inside edge that is stitched to the first longitudinal edge of the main panel along a first longitudinal panel seam;

a second longitudinal panel having an inside edge that is stitched to the second longitudinal edge of the main panel along a second longitudinal panel seam; and a lateral panel having an inside edge that is stitched to the first lateral edge of the main panel along a lateral panel seam;

wherein the first longitudinal panel, the lateral panel and the second longitudinal panel form a border around the first longitudinal edge, the first lateral edge and the second longitudinal edge of the main panel;

a first skirt section stitched to an outside edge of the first longitudinal panel along a first longitudinal skirt seam, where the first longitudinal skirt seam is configured to align with an edge of the bed base where the top surface of the bed base intersects with the first longitudinal side of the bed base;

a second skirt section stitched to an outside edge of the second longitudinal panel along a second longitudinal skirt seam, where the second longitudinal skirt seam is configured to align with an edge of the bed base where the top surface of the bed base intersects with the second longitudinal side of the bed base; and a third skirt section stitched to an outside edge of the lateral panel along a lateral skirt seam, wherein the lateral skirt seam is configured to align with an edge of the bed base where the top surface of the bed base intersects with the first lateral side of the bed base; and wherein the main panel comprises a first fabric and the first skirt section, the first longitudinal panel, the second skirt section, the second longitudinal panel, the lateral skirt section and the lateral panel comprises a second fabric that is different from the first fabric.

8. The bed skirt of claim 7, wherein the first fabric is undyed and wherein the second fabric is dyed and has a higher thread count than the first fabric of the main panel.

9. The bed skirt of claim 7, wherein the main panel is entirely blocked from view when the bed skirt is configured to cover the bed base and when the bed skirt is configured to be located under the mattress.

10. The bed skirt of claim 7, wherein the first longitudinal skirt seam, the second longitudinal skirt seam and the lateral skirt seam provide the bed skirt with permanent folds to the bed skirt.

11. The bed skirt of claim 7, wherein a first end of the first longitudinal panel joins a first end of the lateral panel and a first end of the second longitudinal panel joins a second end of the lateral panel of the platform section at mitered corners, the mitered corners being stitched together.

12. The bed skirt of claim 7, further comprising a top side and a bottom side, wherein the bottom side includes surged seam allowances for the first longitudinal panel seam, the second longitudinal panel seam, the lateral panel seam, the first longitudinal skirt seam, the second longitudinal skirt seam and the lateral skirt seam.

13. A bed skirt configured to cover a four-sided bed base and configured to be located under a mattress, the bed skirt comprising:

a single panel of a first fabric having four side edges and configured to cover a surface area of a top surface of the bed base that is less than a total surface area of the top surface of the bed base;

six panels of a second fabric that is different from the first fabric of the single panel, the six panels including three border panels each having edges stitched to a respective side of the single panel along border seams and three skirt panels each stitched to a respective edge of at least one of the three border panels along skirt seams; and wherein the bed skirt is configured to be arranged on the bed base by aligning the skirt seams with top edges of the bed base, the top edges of the bed base being defined by where the top surface of the bed base intersects with three of the four sides of the bed base so that only each of the three skirt panels cover three of the four sides of the bed base and only the single panel and each of the three border panels covers an entirety of the top surface of the bed base.

14. The bed skirt of claim 13, wherein the single panel made of the first fabric is entirely blocked from view when the bed skirt is configured to cover the bed base and when the bed skirt is configured to be located under the mattress.

15. The bed skirt of claim 13, wherein the skirt seams provide the bed skirt with permanent folds to the bed skirt for configured alignment with the top edges of the bed base.

16. The bed skirt of claim 13, wherein a first end of a first border panel joins a first end of a second border panel and a first end of a third border panel joins a second end of the second border panel at mitered corners, the mitered corners being stitched together.

17. The bed skirt of claim 16, wherein the configured covering of the bed skirt on the bed base further comprises configuring the mitered corners to align with top corners of the bed base, the top corners of the bed base being defined by where the top surface of the bed base intersects with first and second sides of the bed base and where the top surface of the bed base intersect with second and third sides of the bed base.

18. The bed skirt of claim 13, further comprising configuring a bottom side of the bed skirt to be oriented face down on the bed base and configuring a top side of the bed skirt to be oriented face up on the bed base, wherein the bottom side includes surged seam allowances for the border seams and the skirt seams.

* * * * *